United States Patent [19]

Roberts

[11] Patent Number: 4,572,675

[45] Date of Patent: Feb. 25, 1986

[54] APPARATUS FOR AGITATING AND PUMPING A LIQUID SLURRY

[75] Inventor: James R. Roberts, Grayslake, Ill.

[73] Assignee: A. O. Smith Harvestoe Products, Inc., Arlington Heights, Ill.

[21] Appl. No.: 622,989

[22] Filed: Jun. 21, 1984

[51] Int. Cl.[4] ..... B01F 7/16

[52] U.S. Cl. ..... 366/263; 366/288

[58] Field of Search ..... 366/261-265, 366/286-288, 347, 349

[56] References Cited

U.S. PATENT DOCUMENTS

| | | | |
|---|---|---|---|
| Re. 17,683 | 5/1930 | Craddock | 366/286 |
| 936,886 | 10/1909 | Hannold | 285/90 X |
| 1,768,928 | 7/1930 | Peters | 366/264 |
| 1,864,149 | 6/1932 | Rockwell | 366/266 |
| 2,157,683 | 5/1939 | Vollrath | 366/286 |
| 2,517,648 | 8/1950 | Franke | 366/347 |
| 2,541,221 | 2/1951 | Edwards | 366/264 |
| 3,316,843 | 5/1967 | Vaughan | 366/264 X |
| 3,805,891 | 4/1974 | Reinhard et al. | 285/325 |
| 3,877,677 | 4/1975 | Daghe et al. | 74/89.15 |
| 4,358,298 | 11/1982 | Ratcliff | 366/262 |
| 4,416,549 | 11/1983 | Kretschmer | 366/286 X |
| 4,464,259 | 8/1984 | Cramer et al. | 366/286 X |

FOREIGN PATENT DOCUMENTS

| | | | |
|---|---|---|---|
| 1177345 | 3/1965 | Fed. Rep. of Germany | 366/262 |
| 2420605 | 6/1975 | Fed. Rep. of Germany | 366/263 |
| 2950058 | 6/1981 | Fed. Rep. of Germany | 366/261 |
| 132857 | 11/1978 | Japan | 366/265 |

*Primary Examiner*—Philip R. Coe

*Attorney, Agent, or Firm*—Andrus, Sceales, Sstarke & Sawall

[57] ABSTRACT

An improved apparatus for agitating and pumping a liquid slurry, such as manure slurry. The apparatus includes a vertical column mounted for rotation about its axis in a pit or vessel containing the liquid slurry. A motor-pump unit is mounted for rotation about the axis of the column and is also mounted for vertical sliding movement relative to the column. To guide the motor-pump unit in vertical movement on the column, a generally C-shaped guide on the motor pump unit rides on a flat plate-like track on the column. The upper end of the track terminates at a level slightly above the pit, so that by elevating the motor pump unit, the motor-pump unit can be freely removed from connection with the column. The upper end of the pit is enclosed by a closure plate having a central opening, and a rotary deck plate carried by the column encloses the opening and rotates with the column relative to the closure plate. The deck plate has an aperture through which the motor-pump unit can be raised during agitation of the liquid slurry and the aperture is enclosed by a hinge cover. Extending downwardly from the cover is a cam member which is engaged by the motor-pump unit as the motor-pump unit is elevated to lift the cover to an open position. The power cable which is connected to the motor-pump unit is biased upwardly by a counterweight to prevent entanglement of the cable when the motor-pump unit is in an upper position.

16 Claims, 5 Drawing Figures

APPARATUS FOR AGITATING AND PUMPING A LIQUID SLURRY

BACKGROUND OF THE INVENTION

In manure collecting systems, the manure is delivered from the barn or other livestock area to a collection pit where it is diluted with water and subsequently transferred to a manure storage tank or to a mobile manure distributing vehicle. To agitate or homogenize the manure stored in the pit, a motor-pump unit is utilized. By raising and lowering the pump, as well as rotating the pump within the pit, the manure can be thoroughly agitated or homogenized. After agitation, the pump is lowered to its lowermost position which automatically connects the outlet of the pump to an outlet pipe so that the manure slurry can then be discharged to the location of use.

In some installations, a submersible motor-pump unit is employed which, in operation, can be submerged beneath the level of the liquid slurry within the pit. In other installations, an above pit motor is employed which is connected to the pump through an elongated vertical drive shaft. In either case, the motor and pump are an integral unit and can be moved both vertically within the pit and rotated about the axis of the supporting column to provide the necessary agitation.

It is often necessary to remove the conventional motor-pump unit from the pit and to accomplish the removel, the pump is raised to its uppermost position and is disconnected from the vertical guide column. As the connection between the pump and the vertical column in the conventional unit may be 18 inches beneath the level of the pit, it is necessary for the operator to lean down into the pit in an awkward position in an attempt to disconnect the pump from the guide column. Because of this, there has been a distinct need for a system in which the motor-pump unit can be automatically disconnected from the guide column as it is raised above the level of the pit.

With the use of a submersible motor, the power cable extends from the top of the supporting column down into the pit and is connected to the motor. As the motor-pump unit is elevated during the agitation cycle, the cable will become slack and drape on the rotary deck. In some instances, the cable has fallen down into the pit to interfere with operation of the pump, while in other instances, the cable, during rotation of the deck plate, has been seriously abraded.

SUMMARY OF THE INVENTION

The invention is directed to an improved apparatus for agitating and pumping a liquid slurry, such as manure slurry. In accordance with the invention, a vertical supporting column is mounted for rotation about its axis in a pit containing the liquid slurry. A submersible motor-pump unit is mounted for rotation about the axis of the column as well as being mounted for sliding vertical movement on the column. By raising and lowering the motor-pump unit within the pit, as well as rotating the unit about the axis of the column, the slurry can be fully agitated or homogenized. After agitation, the motor-pump unit is lowered to its lowermost level, which automatically connects the outlet of the pump to a discharge pipe, so that the slurry can then be discharged from the pit to the desired storage location or location of use.

The invention includes an improved guide mechanism for guiding the motor-pump unit in vertical movement on the supporting column. A flat plate-like track is attached to the column, and a guide member is mounted on the motor-pump unit and includes a pair of opposed guide channels which engage the side edges of the guide track.

The upper end of the track terminates above the pit, so that by elevating the motor-pump unit, the motor-pump unit can be freely disengaged from connection to the supporting column. The automatic disengagement of the vertical guide mechanism is a substantial improvement over prior constructions which required manual disengagement of the motor-pump unit from the supporting column, often at an awkward and inaccessible location.

As a further feature of the invention, an improved closure plate construction is provided for the pit. More particularly, the upper end of the pit is enclosed by a plate having a central opening and a rotary deck plate carried by the column encloses the opening and rotates with the column relative to the closure plate. The rotary deck plate has an aperture through which the motor-pump unit can be elevated during the agitation mode, and the aperture is normally enclosed by a cover which is hinged to the deck plate. Extending downwardly from the plate within the pit is a cam member which is adapted to be engaged by the motor-pump unit as it is elevated in the pit. Engagement of the motor-pump unit with the cam member will act to pivot the cover to an open position to permit the motor-pump unit to be raised above the level of the pit and will permit the cover to return to a closed position when the motor-pump unit is lowered, without hanging up on the motor-pump unit.

The invention also includes a novel cord retraction mechanism. In this regard, a power cable which is interconnected between a suitable source of electric power and the submersible motor extends downwardly into the pit. The power cable is biased upwardly by a counterweight mechanism which maintains the cable off the deck plate and prevents the cable from slackening and draping over the deck plate as the motor-pump unit is elevated. This insures that the cable will not be entangled with the rotary deck plate and will not be abraded as the motor-pump unit is raised and lowered during the agitation cycle.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 5:
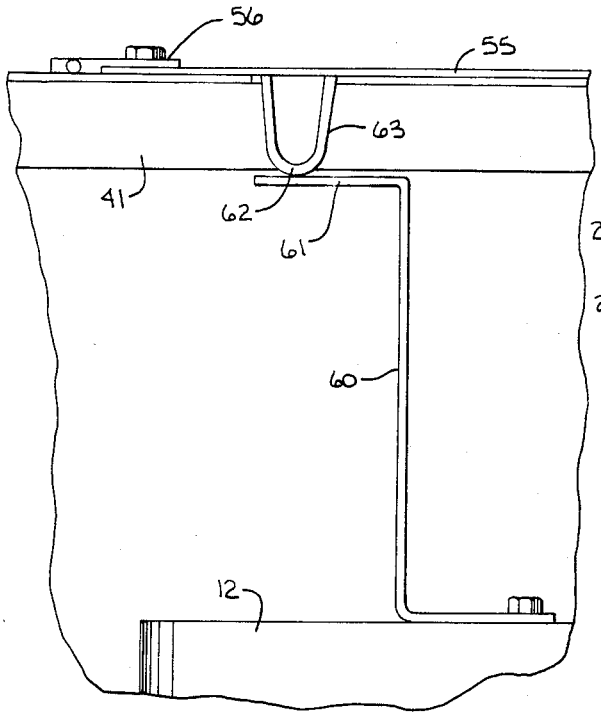
FIG. 5 is an enlarged fragmentary side elevation of the cam mechanism for pivoting the cover.
Figure 1:
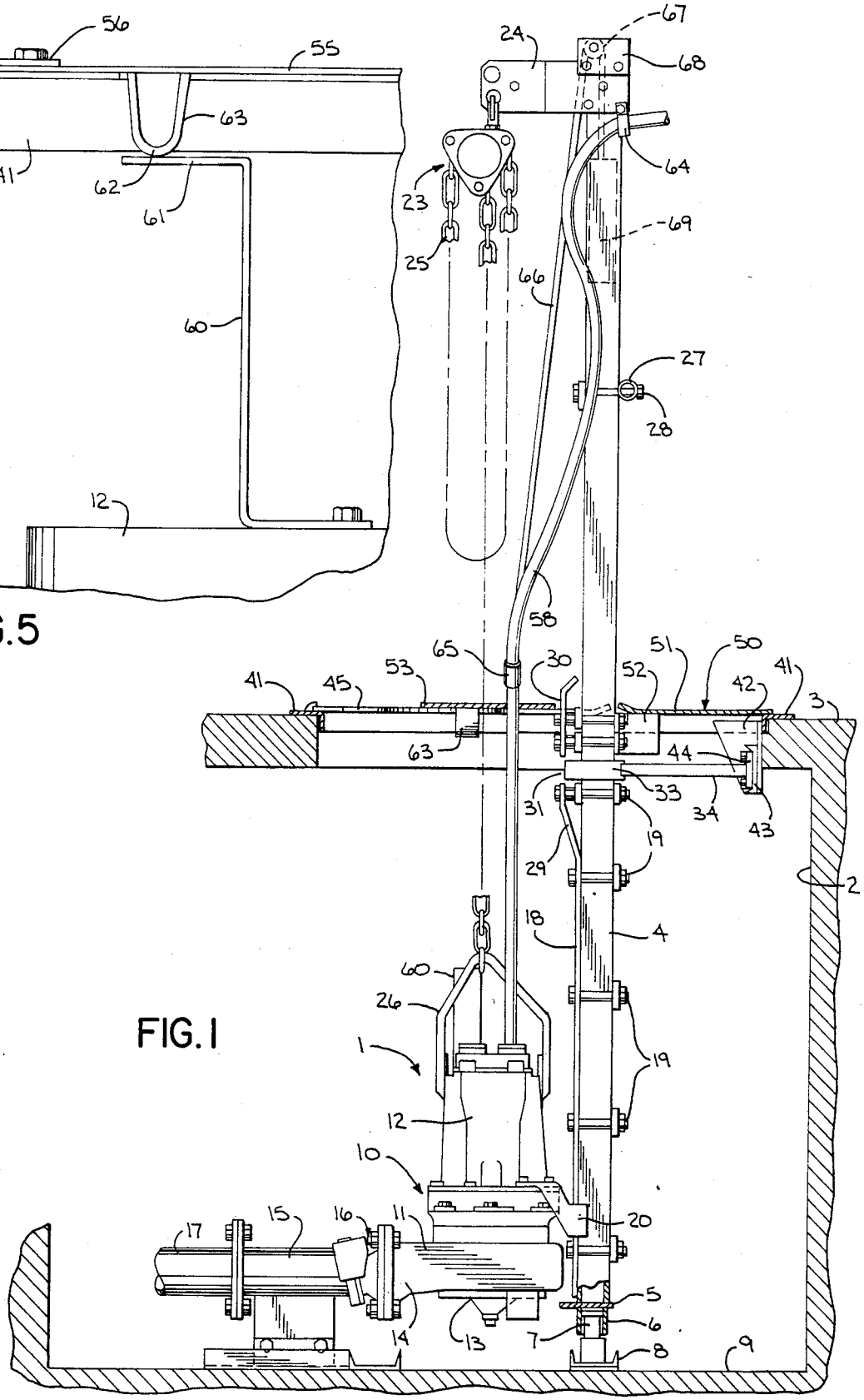
FIG. 1 is a vertical section showing the apparatus of the invention as installed in a pit.

FIG. 1 shows an apparatus 1 for agitating and pumping a liquid slurry such as a manure slurry which is contained within a pit or vessel 2 formed in floor or foundation 3.

The apparatus 1 includes a vertical column 4 having a generally square cross section which is mounted for rotation about its axis in pit 2. As shown in FIG. 1, the lower end of the hollow column 4 is closed off by bottom plate 5 and a tubular sleeve 6 is welded to the lower surface of plate 5 and receives a bearing for pivot 7 that is supported from channel 8 mounted on the floor 9 of the pit. With this construction, the column 4 is freely rotatable about the axis of the bearing 6.

A motor-pump unit 10 is connected to column 4 and is adapted to slide vertically relative to the column. Motor-pump unit 10 includes a centrifugal pump 11 which is driven by an electrical motor 12. Motor 12 is a submersible type and can be fully or partially submerged within the slurry in pit 2.

Pump 11 includes a downwardly facing central inlet 13 and a generally radial outlet 14. When the motor-pump unit is in its lowermost position, as shown in FIG. 1, outlet 14 of pump 11 will be automatically connected to an outlet pipe 15 through the wedge coupling indicated by 16. The wedge coupling in itself is conventional and forms no part of the present invention.

As shown in FIG. 1, the outlet pipe 15 is supported by a bracket from the floor 9 of the pit and can be connected to a suitable discharge pipe 17, which will conduct the slurry either to a manure storage tank or to a manure spreading vehicle.

Figure 3:
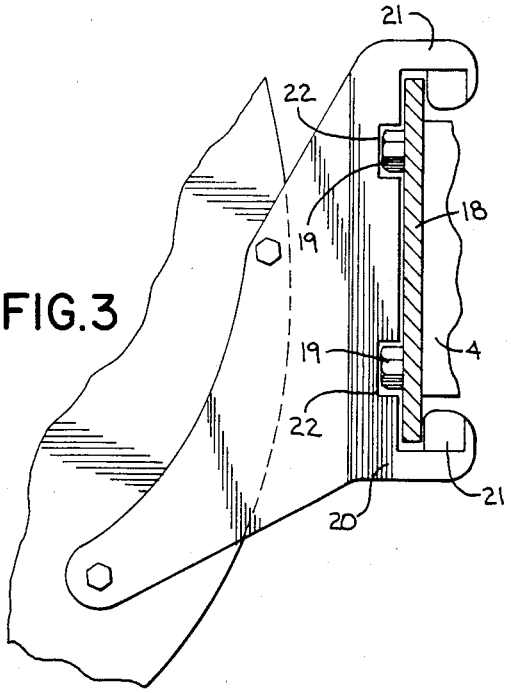
FIG. 3 is an enlarged horizontal section showing the connection of the motor-pump guide member and the guide track.

The guide mechanism for guiding the motor-pump unit in sliding vertical movement relative to column 4, includes a generally flat track 18 which is connected to column 4 by a series of bolts 19. As illustrted in FIG. 3, the side edges of the track project outwardly from the corresponding sides of column 4.

Track 18 is engaged by a guide member 20 which is mounted on the base of motor 12. Guide member 20 includes a pair of opposed guide channels 21 which engage the projecting side edges of track 18. In addition, the body of guide member 20 is provided with a pair of recesses 22 which provide clearance for the heads of the bolts 19 that connect the track 18 to the column 4.

The motor-pump unit 10 can be raised and lowered relative to the column 4 during the agitation cycle by any conventional lifting mechanism. As shown in the drawings, a chain hoist 23 is mounted on the outer end of a plate 24 attached to the upper end of column 4. Hoist 23 includes a chain 25 which is connected to a bale 26 mounted on the upper end of motor 12. Through operation of hoist 23, the motor-pump unit can be raised and lowered within the pit.

In addition to vertical movement, the motor-pump unit 10 is also adapted to rotate with column 4 about the axis of the column during the agitation operation. To rotate the column and the motor-pump unit 10, a handle 27 is connected to the upper end of the column by bolts 28.

When it is desired to agitate the slurry in the pit, the pump 11 is operated and the motor-pump unit 10 is raised and lowered in the pit through operation of hoist 23, as well as being rotated by manual operation of handle 27. The discharge from the pump will thus fully agitate and homogenize the liquid slurry within the pit.

Figure 2:
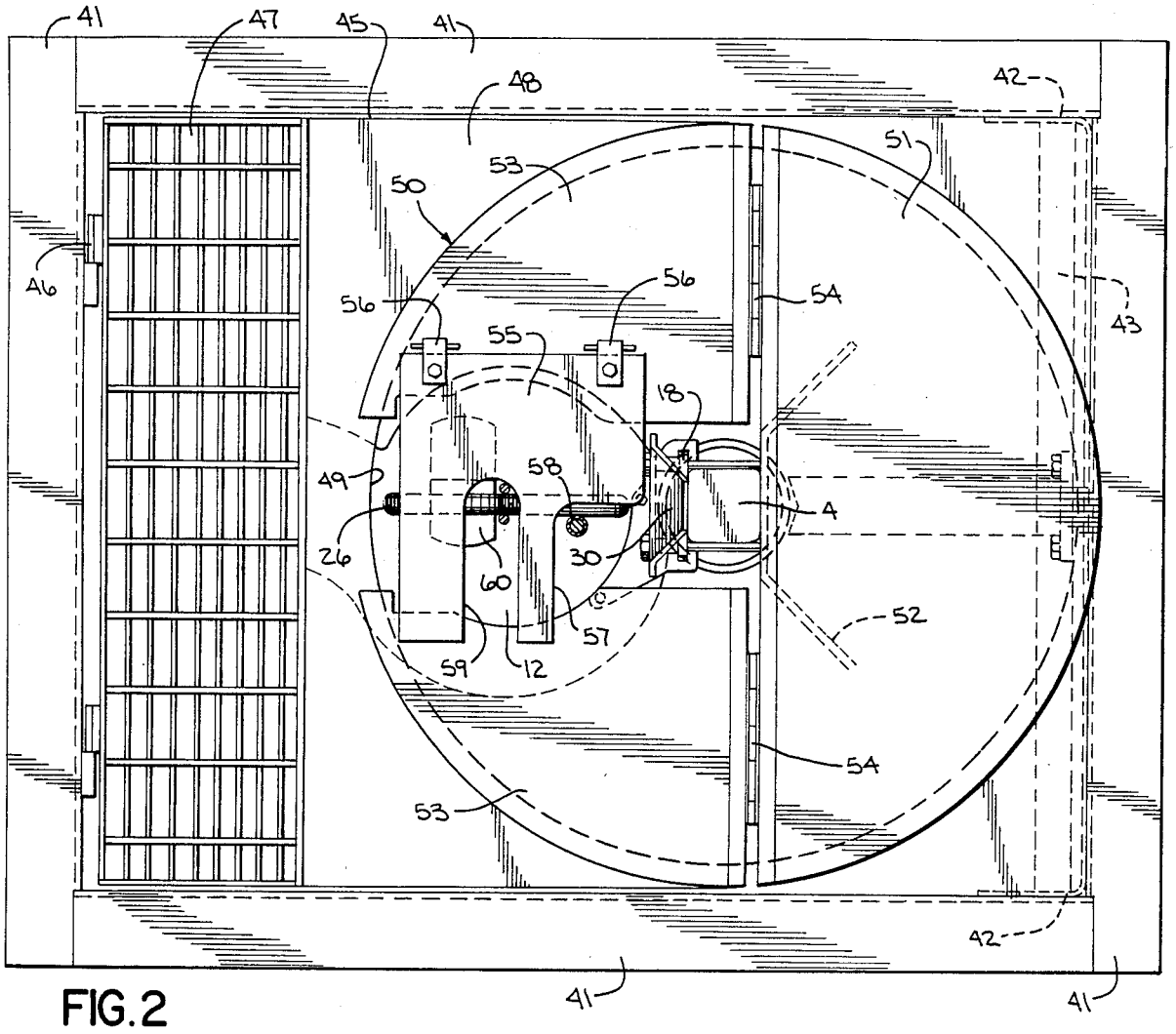
FIG. 2 is a top plan view of the closure plate for the pit.

As a feature of the invention, the motor-pump unit 10 can be automatically and freely disengaged from the column 4 when the motor-pump unit is elevated to a level above the pit. In this connection, track 18 includes an inclined section 29, which extends upwardly and outwardly from column 4, and upper end of inclined section 29 is separated from the upper section 30 of track 18 by a gap or interruption indicated by 31. The upper end of upper section 30 is inclined inwardly toward the column as best shown in FIGS. 1 and 2.

The inclined section 29 of track 18 is utilized in order to accommodate a journaling collar 33 which supports column 4 for rotation. As shown in FIG. 1, journalling collar 33 is supported by arm 34 from floor 3. With this construction, the inclined section 29, enables the guide member 20 to be moved upwardly around the collar 33 when the motor-pump unit 10 is elevated above floor 3, and the gap 31 permits the column 4 and track 18 to be rotated without interference from supporting arm 34.

Figure 4:
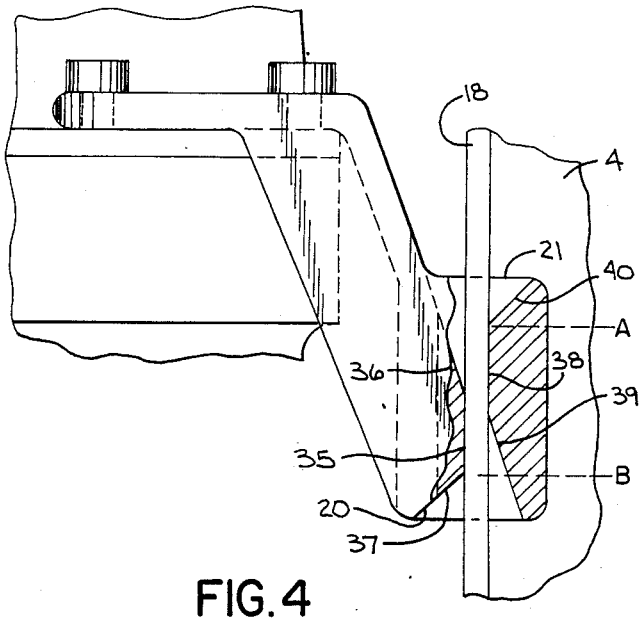
FIG. 4 is a side elevation of the structure shown in FIG. 3, with parts broken away.

As shown in FIG. 4, the guide channels 21 on guide member 20 each include a central vertical surface 35 which is bordered by an upper inclined surface 36, disposed at an angle of about 30° to the vertical, and a lower inclined surface 37 located at an angle of about 45° to the vertical. Similarly, the opposed surface of each guide channel 21 includes a central vertical surface 38 which is offset upwardly from central surface 35. In addition, an inclined surface 39 located at an angle of about 30° to the vertical is positioned below central surface 38 and an upper inclined surface 40, disposed at an angle of about 45° to the vertical, is located above central surface 38. The inclination of surfaces 36 and 39 conforms generally to the inclination of track section 29 and enables the motor-pump unit to be retained in a vertical position as guide member 20 rides on the offset or inclined section 29 of the track on raising and lowering of the motor-pump unit.

When it is desired to elevate the motor-pump unit 10 to a level above pit 2, either for maintenance or to remove the motor-pump unit for installation in a second pit, hoist 23 is operated to elevate the motor-pump unit. As the motor-pump unit is elevated, guide 20 will move upwardly along the inclined section 29 of track 18 and over the interruption 31 onto the upper section 30. Continued upward movement of the motor-pump unit will automatically and freely disengage guide member 20 from the guide track 18. The vertical height of the gap 31 is less than the distance from points A to B on the guide member, so that the guide member will not be disengaged from the track 18 as it passes over the gap 31.

As best shown in FIGS. 1 and 2, a curb angle 41 is secured to floor 3 bordering pit 2 and a pair of corner brackets 42 are secured to curb angle 41 at two corners of the pit. Channel 43 extends between corner brackets 42 and, as shown in FIG. 1, projects downwardly beneath the lower surface of floor 3. Plate 44 is connected to channel 43 by bolts and the outer end of arm 34 is welded to plate 44. As previously noted, arm 34 supports the journalling collar 33 for column 4.

As best illustrated in FIG. 2, the upper end of pit 2 is enclosed by a closure plate 45 which is pivoted along one side to curb angle 41 by hinges 46. Closure 45 includes a section of open grating 47, as well as a solid plate section 48, which is provided with a central opening 49.

As shown in FIG. 2, a rotary deck plate 50 is carried by column 4 and encloses the central opening 49 in closure 45. Deck plate 50 includes a semi-cylindrical section 51 which is mounted on a generally U-shaped bracket 52 secured to column 4 through bolts 19. In addition, deck plate 50 has a pair of hinge sections 53 which are hinged to semi-circular section 51 through hinges 54. As shown in FIG. 2, the peripheral edge of deck plate 50 overlaps the portion of closure plate 45 bordering opening 49, and the deck plate will rotate with rotation of motor-pump unit 10 and column 4 relative to closure plate 45.

As illustrated in FIG. 2, the opposed edges of sections 53 of deck plate 50 are spaced apart and a cover 55 is adapted to partially enclose the space between sections 53. Cover 55 is hinged to one of the sections 53 through a pair of strap hinges 56 so that the cover can be opened and closed relative to the sections 53.

The free edge of cover 55 is provided with a recess 57 through which the power cable 58 leading to motor 12 extends. In addition to recess 57, cover 55 is provided provided with a slot 59 which receives the hoist chain 25.

A mechanism is included to automatically raise and lower cover 55 as the motor-pump unit 10 is raised and lowered within pit 2. In this regard, a Z-bracket 60 is attached to the upper end of motor 12 and Z-bracket 60 includes an upper generally horizontal surface 61 which is adapted to engage the lower surface 62 of cam bracket 63 that is attached to the lower surface of cover 55. As the motor-pump unit 10 moves upwardly, upper surface 61 will engage the cam surface 62 to roll cover 55 upwardly. If the cover is not moved to an over-center position, it will follow downward movement of the motor-pump unit. On the other hand, if the cover is moved to an over-center position through upwardly movement of motor-pump unit 10, the cover can be returned to its closed position through manual operation.

Power cable 58 connects motor 12 with a suitable source of electric power, and as shown in FIG. 1, cable 58 is supported on the upper end of column 4 by strap 64. In addition, a clamp 65 is attached to cable 58 at a location slightly above pit 2 and clamp 65 is connected to one end of a flexible cable 66. Cable 66 extends over a pulley 67 journaled on bracket 68 connected to upper end of column 4, and the opposite end of cable 66 is connected to a counterweight 69 which is adapted to slide within the hollow interior of column 4. Counterweight 69 acts to bias the cable upwardly and thus will tend to urge the cable upwardly away from the rotary deck 50. This prevents the cable from draping into the pit as the motor-pump unit is elevated, which could cause interference with operation of pump 12, and also ensures that the cable will not abrade against the edges of the deck plate or cover as the motor-pump unit is raised and lowered.

When it is desired to agitate the slurry in pit 2, the motor-pump unit 10 is raised and lowered within the pit through operation of hoist 23 and is simultaneously rotated about the axis of column 4. During this movement, the discharge from pump 12 will thoroughly mix or agitate the slurry within the pit. As the motor-pump unit 10 is elevated during agitation, counterweight 69 will bias cable 58 upwardly away from the rotary deck, and as the motor-pump unit approaches the top of the pit, bracket 60 will engage the cam surface 62 to roll open the cover to permit the motor to project upwardly above the pit. As the motor-pump unit is lowered, cover 55, if not in an overcenter position, will automatically return to its closed position. The bracket 60 and cam surface 62 provide a smooth opening action for cover 55 and prevent the cover from catching and hanging up on the motor 12.

After the agitation has been completed, the motor-pump unit 10 is lowered to its lowermost position which will automatically connect outlet 14 of pump 12 with outlet pipe 15 through the wedge coupling 16. Continued operation of the pump will then discharge the slurry through the outlet pipe 15 to the exterior of the pit.

Various modes of carrying out the invention are contemplated as being within the scope of the following claims particularly pointing out and distinctly claiming the subject matter which is regarded as the invention.

I claim:

1. An apparatus for agitating and pumping a liquid, a vessel to contain the liquid, a vertical column disposed in the vessel with the upper end of the column projecting above the level of the vessel, means for supporting said column for rotation about its axis and including journalling means disposed adjacent the upper end of said vessel, a motor-pump unit, first guide means on said column with the upper end of said first guide means terminating above said vessel, and second guide means on said motor-pump unit and engageable with said first guide means for guiding said motor-pump unit for vertical movement on said column, said second guide means being freely disengaged with said first guide means on elevation of said motor-pump unit to a predetermined elevated position, said first guide means comprising a track, said track having an outwardly inclined section disposed to avoid inteference with said journalling means.

2. The apparatus of claim 1, and including means on said second guide means for permitting the motor-pump unit to remain in a vertical attitude as said second guide means moves on said inclined section of the track.

3. The apparatus of claim 2, wherein said journalling means includes a journalling collar and an arm connecting said collar to said vessel, said track having an interruption disposed in alignment with said arm to permit rotation of said motor-pump unit in said vessel.

4. The apparatus of claim 3, wherein the upper section of said track disposed above said interruption is generally parallel to the section of the track disposed beneath said inclined section.

5. The apparatus of claim 2, wherein said second guide means is a channel having a pair of opposed sections bordering said track, each section having a vertical surface with said vertical surfaces being offset vertically from each other, each section also having an inclined surface disposed opposite the vertical surface of the other section.

6. The apparatus of claim 5, wherein the inclined surfaces are disposed at substantially the same angularity to the vertical as the inclined portion of said track, whereby said motor-pump unit will be retained in a vertical attitude as said second guide means moves over said inclined portion of the track.

7. An apparatus for agitating and pumping a liquid slurry, comprising a structure having a pit to contain said slurry, a vertical column disposed within the pit and having an upper end projecting upwardly above the pit, a motor-pump unit for agitating the slurry in the pit and for discharging the agitated slurry from the pit, a track connected to the column and having a pair of side edges projecting beyond the corresponding sides of said column, a guide member mounted on the motor-pump unit and having a pair of opposed side channels to receive the side edges of the track, journalling means disposed adjacent the upper end of the pit for journaling the column for rotation about its axis, said track having an inclined portion extending upwardly and outwardly from said column and located beneath said journaling means, and means for retaining the motor-pump unit in a vertical attitude as said guide means moves on said inclined portion of the track.

8. The apparatus of claim 7, wherein each guide channel has a pair of opposed sections bordering the track, each section having a vertical surface with the vertical surfaces of said section being offset vertically from each other, and each section having an inclined surface disposed opposite the vertical surface of the other section, said inclined surfaces being disposed at substantially the same angularity to the vertical as the inclined portion of said track, said track being retained between said vertical surfaces as the guide member rides on the vertical portion of the track and said track being retained between said inclined surfaces as said guide means moves on the inclined portion of the track.

9. The apparatus of claim 7, wherein said track includes an upper portion located above said inclined section and disposed generally parallel to the portion of the track disposed below said inclined portion, said journalling means including a journalling collar, and an arm connecting said collar to said structure, said track having an interruption disposed in alignment with said arm to permit 360° rotation of said motor-pump unit and said column in said pit.

10. An apparatus for agitating and pumping a liquid slurry, comprising a foundation having a pit therein, a generally vertical column disposed within the pit with the upper end of the column projecting upwardly above the pit, a motor-pump unit, means for mounting the motor-pump unit for rotation about the axis of said column, means for mounting the motor-pump unit for vertical movement on said column, a deck plate connected to the motor-pump unit and disposed substantially flush with the upper surface of the foundation and disposed to rotate with said motor-pump unit, said deck plate having an opening through which the motor-pump unit can project as the motor-pump unit is raised within the pit, a cover hinged to said deck plate and adapted to open and close said opening, and means responsive to the motor-pump unit being raised to a predetermined elevation for moving said cover from the closed position toward the open position.

11. The apparatus of claim 10, and including a closure plate to enclose the upper end of the pit and having a generally circular aperture therein, said deck plate enclosing said aperture and being disposed to rotate relative to said closure plate on rotation of said motor-pump unit.

12. The apparatus of claim 10 wherein said deck plate includes a generally semi-circular section and a pair of side sections each hinged to said semi-circular section, said side sections being spaced apart to define said opening.

13. The apparatus of claim 10, wherein said means responsive to the motor-pump unit raised to a predetermined elevation comprises a cam member depending from the cover and having a generally curved cam surface, said motor-pump unit having an upwardly projecting member disposed to engage said cam surface as the motor-pump unit is raised.

14. An apparatus for agitating and pumping a liquid slurry, comprising a foundation having a pit therein, a generally vertical column disposed in the pit with the upper end of the column projecting a substantial distance above the pit, a motor-pump unit, means for mounting the motor-pump unit for vertical movement relative to said column, means for raising and lowering said motor-pump unit, power means for operating said motor-pump unit and including a flexible power cable attached to the motor-pump unit and extending upwardly from the pit and connected to a source of power, and biasing means connected to said power cable and exerting an upward force to urge the power cable up from the pit as the motor-pump unit is elevated in the pit.

15. The apparatus of claim 14, wherein said biasing means comprises a counterweight, and a flexible line, one end of said line being connected to said power cable and the opposite end of said line being connected to said counterweight, said biasing means also including a pully mounted on said column to support the portion of the line located between said power cable and said counterweight.

16. The apparatus of claim 14, wherein said column is hollow and said counterweight is disposed to move within the hollow interior of said column.

* * * * *

UNITED STATES PATENT AND TRADEMARK OFFICE

CERTIFICATE OF CORRECTION

PATENT NO. : 4,572,675

DATED : February 25, 1986

INVENTOR(S) : JAMES R. ROBERTS

It is certified that error appears in the above-identified patent and that said Letters Patent is hereby corrected as shown below:

At "[73] Assignee" Cancel "A. O. SMITH HARVESTOE PRODUCTS INC." AND SUBSTITUTE THEREFOR ---A. O. SMITH HARVESTORE PRODUCTS INC.---

Signed and Sealed this

*Fifth* Day of *August 1986*

[SEAL]

*Attest:*

DONALD J. QUIGG

*Attesting Officer*

*Commissioner of Patents and Trademarks*